US010723531B2

(12) United States Patent
Sheregar et al.

(10) Patent No.: US 10,723,531 B2
(45) Date of Patent: Jul. 28, 2020

(54) DISPLAY READY OUTER CONTAINER FOR STRIP PACK WITH BUILT-IN HANGERS

(71) Applicant: Intercontinental Great Brands LLC, East Hanover, NJ (US)

(72) Inventors: Venkatesh Sheregar, Thane (IN); Amey Ganu, Thane (IN); Sameer Mehendale, Mumbai (IN); Jaswinder Dhadda, Toronto (CA)

(73) Assignee: International Great Brands LLC, East Hanover, NJ (US)

( * ) Notice: Subject to any disclaimer, the term of this patent is extended or adjusted under 35 U.S.C. 154(b) by 0 days.

(21) Appl. No.: 15/544,588

(22) PCT Filed: Jan. 26, 2016

(86) PCT No.: PCT/US2016/014848
§ 371 (c)(1),
(2) Date: Jul. 19, 2017

(87) PCT Pub. No.: WO2016/130313
PCT Pub. Date: Aug. 18, 2016

(65) Prior Publication Data

US 2018/0002089 A1 Jan. 4, 2018

Related U.S. Application Data

(60) Provisional application No. 62/115,701, filed on Feb. 13, 2015.

(51) Int. Cl.

| | |
|---|---|
| ***B65D 75/52*** | (2006.01) |
| ***B65D 75/42*** | (2006.01) |
| ***B65D 5/10*** | (2006.01) |
| ***B65D 75/56*** | (2006.01) |

(Continued)

(52) U.S. Cl.
CPC ..... *B65D 75/525* (2013.01); *B65D 5/10* (2013.01); *B65D 5/4208* (2013.01);
(Continued)

(58) Field of Classification Search
CPC ..... B65D 75/525; B65D 5/10; B65D 5/106; B65D 5/4208; B65D 5/4266; B65D 75/42;
(Continued)

(56) References Cited

U.S. PATENT DOCUMENTS 2,122,048 A * 6/1938 Shapiro ..... B65D 5/4208 206/494
2,758,710 A 8/1956 Arens
(Continued)

FOREIGN PATENT DOCUMENTS

| | | |
|---|---|---|
| CN | 202897018 U | 4/2013 |
| DE | 200 07 607 U1 | 6/2000 |
| EP | 0 133 973 A2 | 3/1985 |
| EP | 2450288 A2 | 5/2012 |
| WO | 88/10220 A1 | 12/1988 |

*Primary Examiner* — Rafael A Ortiz
(74) *Attorney, Agent, or Firm* — Hoffmann & Baron, LLP

(57) ABSTRACT

A container (10) for transporting and displaying strip pack products (20) generally includes a container housing (30) defining a housing interior for containing strip pack products (20). The container housing has at least one flap (32) pivotable between a closed position at least partially enclosing the housing interior and an open position, wherein the strip pack product (20) is suspended from the at least one flap (32) in the open position.

3 Claims, 3 Drawing Sheets

(51) Int. Cl.
*B65D 5/42* (2006.01)
*B65D 77/04* (2006.01)

(52) U.S. Cl.
CPC ..... *B65D 5/4266* (2013.01); *B65D 75/42* (2013.01); *B65D 77/0413* (2013.01); *B65D 75/566* (2013.01)

(58) Field of Classification Search
CPC .... B65D 75/566; B65D 75/563; B65D 75/52; B65D 75/56; B65D 5/42
USPC ..... 206/774, 736, 45.28, 45.29, 737, 766, 206/756, 731, 364, 366, 751; 221/70, 73; 229/117.09, 117.23, 124
See application file for complete search history.

(56) References Cited

U.S. PATENT DOCUMENTS

| | | | | |
|---|---|---|---|---|
| 2,858,059 | A | 10/1958 | Kitchell | |
| 4,311,268 | A * | 1/1982 | Soliven | B65D 5/46096 229/117.12 |
| 6,021,919 | A | 2/2000 | Kelly | |
| 7,516,596 | B2 * | 4/2009 | Henderson | B26F 1/14 206/494 |
| 8,646,605 | B2 * | 2/2014 | Zimmerman | B65D 5/542 206/440 |
| 2008/0264964 | A1 | 10/2008 | Kaiser et al. | |
| 2011/0079606 | A1 * | 4/2011 | Weston | B65D 5/10 221/282 |
| 2013/0126548 | A1 * | 5/2013 | Pourian | B65D 83/0472 221/70 |

* cited by examiner

DISPLAY READY OUTER CONTAINER FOR STRIP PACK WITH BUILT-IN HANGERS

CROSS REFERENCE TO RELATED APPLICATIONS

This application is the National Stage of International Application. No. PCT/US2016/014848, which designates the U.S., filed Jan. 26, 2016, which claims the benefit of U.S. Provisional Patent Application No. 62/115,701 filed Feb. 13, 2015, the contents of all of which are incorporated herein by reference in its entirety.

FIELD OF THE INVENTION

The present invention relates to a container for consumable products. More particularly, the present invention relates to a display ready outer container with built in hangers for strip packs packed on flow wrapping machines.

BACKGROUND OF THE INVENTION

Consumable products such as gum, candy pieces, cheese, grocery strip/sachet packs, beverage packs (i.e. coffee/malted food drinks), low unit packs, etc. are packaged in a variety of manners. One type of packaging is termed a "strip pack" in which portions of the product are wrapped in a plastic material and are connected to each other in a strip form. Typically, a perforation is provided in the packaging material between each wrapped product so that the wrapped products can be disconnected from each other.

In the retail sale of such products, it is often desirable to display the products in a manner that will allow for easy identification and selection by the consumer. In this case, the strip pack arrangement of the products lends itself to a hanging display, in which the products can be hung from a hanger, and wherein one or more wrapped products can be easily removed from the strip by the consumer for purchase. The unpurchased products of the strip remain hanging from the hanger for other consumers to purchase.

The current conventional packaging for such hanging displays includes individual hangers made of paper board, with nylon strings for hanging. At the manufacturer, these hangers are packed in non-display shipping cartons, together with the strip pack products, and shipped to the retailer for sale to the consumer. The hangers are removed from the shipping carton and the strip pack products are hung from the hangers. The completed display is then supported at a convenient location at the retailer for consumer selection and the outer shipping carton is discarded.

It can be appreciated that providing an outer shipping carton for the hangers and strip pack products adds to the expense of packaging. It can also be appreciated that discarding the outer shipping container after use has a detrimental impact on the environment. Accordingly, it would be desirable to provide a display for strip pack products with minimal expense and with a reduced impact on the environment.

SUMMARY OF THE INVENTION

In one aspect of the present disclosure, a container for transporting and displaying strip pack products is provided. The container generally includes a container housing defining an interior for containing strip pack products, wherein the container housing has at least one flap pivotable between a closed position and an open position. In the closed position, the flap at least partially encloses the housing interior and, in the open position, the flap permits access to the interior of the container. The display further includes a strip pack product suspended from the container flap when the flap is in its open position.

In a preferred embodiment, the flap is formed with an opening for suspending the strip pack therefrom. The container is further preferably formed with a mounting opening for mounting the container to a support. Also, the container is preferably formed by folding a single blank of stock material.

In another aspect of the invention, a method for displaying strip pack products is provided. The method generally includes storing a strip pack product within an interior of a container, shipping the container to a retail location, opening a flap of the container to access the container interior, removing the strip pack from the container interior, suspending the strip pack from the open flap of the container and mounting the container to a support at the retail location.

In another aspect of the invention, a blank of stock material for forming a strip pack product display is provided. The blank generally includes a plurality of side wall panels arranged in a row with adjacent side wall panels pivotably connected to each other about a fold line, a bottom panel pivotably connected to a sidewall panel about a fold line and a flap panel pivotably connected to a sidewall panel about a fold line. The flap panel extends from the side wall panel in a direction opposite the bottom panel and also has at least one opening formed therethrough for suspending a strip pack product for display. The blank is foldable to form a container having an interior defined by a plurality of side walls formed by the side wall panels, a bottom formed at least in part by the bottom panel and a flap formed by the flap panel opposite the bottom. The flap is pivotable between a closed position at least partially enclosing the container interior and an open position for displaying the strip pack product.

In a preferred embodiment, each side panel of the blank is pivotably connected at one end with a respective bottom panel and is pivotably connected at an opposite end with a respective flap panel. Also, at least one side panel is formed with a mounting opening therethrough for mounting the display to a support.

Thus, the present invention captures the specific design solutions developed to avoid separate paperboard hangers. The invention and design interventions make use of the flaps of the secondary packaging outer cartons as extended flaps to build in the hanging slots for the strips within the flaps of the carton.

The built in hangers not only saves additional and separate material for individual hangers, but also provides a ready solution for display. Once the strips packs are packed into the carton the display outers will just have to be opened, inverted and tapped to show the display ready solution.

Features of the disclosure will become apparent from the following detailed description considered in conjunction with the accompanying drawings. It is to be understood, however, that the drawings are designed as an illustration only and not as a definition of the limits of this disclosure.

DETAILED DESCRIPTION OF PREFERRED EMBODIMENTS

Figure 1:
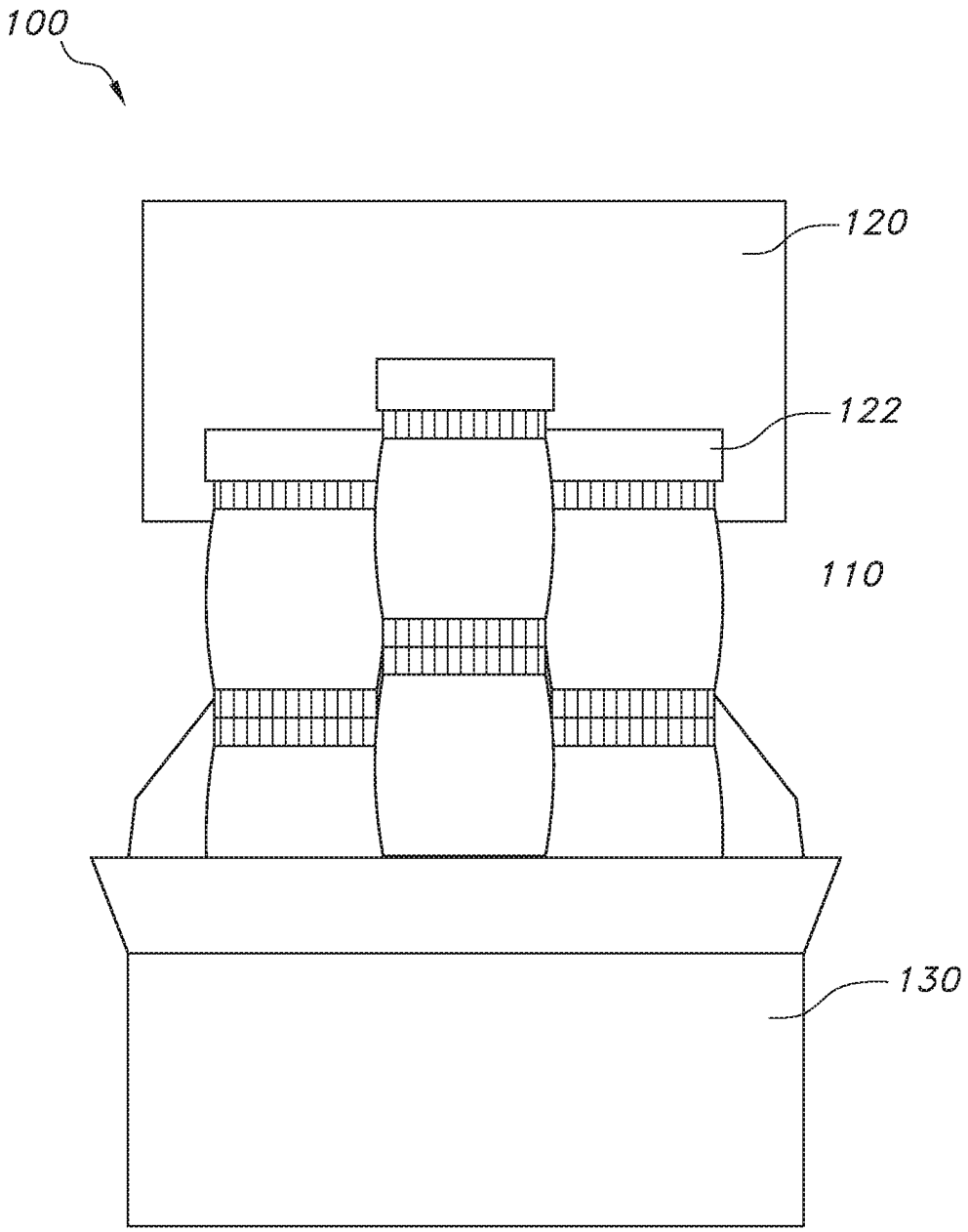
FIG. 1 (PRIOR ART)
FIG. 1 is a perspective view of a conventional hanger display provided with strip pack products in a shipping carton, according to the prior art.

A conventional strip pack display 100 of the prior art is shown in FIG. 1. As described above, the conventional display 100 includes a plurality of strip-like packaged products 110 that are hung from a component hanger 120. The component hanger 120 is cardboard and has openings 122 extending therethrough through which the strips of packages 110 are supported. The component hanger 120 and the strips 110 are encased in an outer shipping carton or box 130. When the box 130 is opened, the component hanger 120 can be lifted out from the box and the strip products 110 will hang therefrom. The component hanger 120 can then be mounted or hung in a wide variety of manners so as to allow the strip products 110 to hang down for display.

Figure 3:
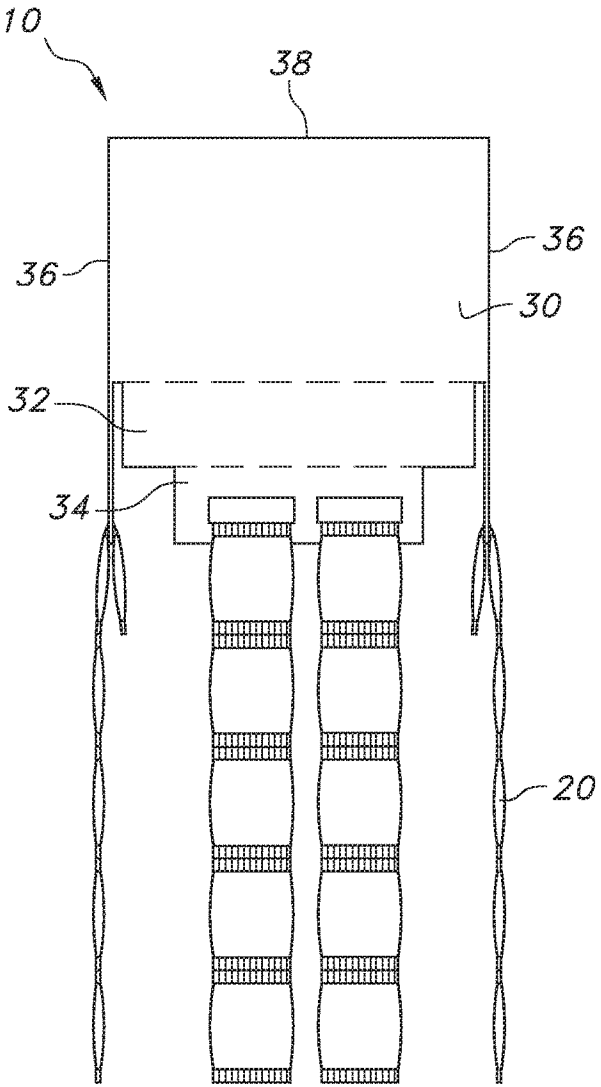
FIG. 3 is a perspective view of the display container shown in FIG. 1 after opening with strip pack products hanging from the built-in hangers.
Figure 2:
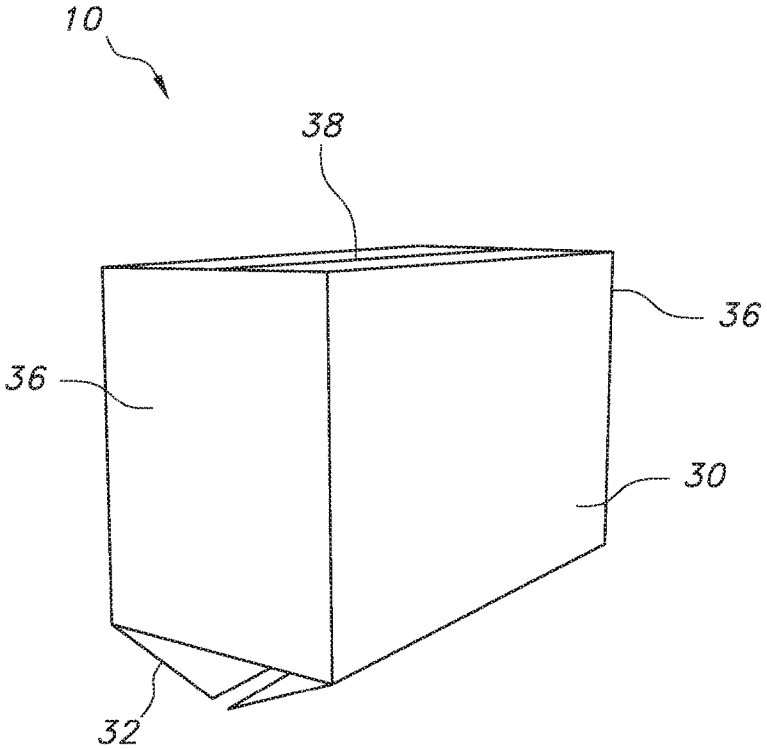
FIG. 2 is a perspective view of the display container of the present invention before opening.

Turning now to FIGS. 2 and 3, the present invention relates to a combined shipping and display package 10 for supporting and displaying a strip of products 20. The strip products 20 can be any products packaged in a strip form, as described above, and configured so as to allow for individual detachment of one wrapped product from another. The strip products 20 are suitably labeled and adapted to be displayed in a hanging fashion for selection and purchase by a consumer.

The display package 10 of the present invention includes a container 30, which serves as both a shipping carton for the strip products 20 and a display hanger for the products at the retailer location. Thus, as shown in FIGS. 2 and 3, the separate outer carton and hangers of the prior art are integrated into a single container 30 such that the hanger is, in fact, the outer carton.

As shown in FIG. 2, the container 30 forms a familiar rectangular box defining an interior for containing the strip products 20 for shipping to a retailer location. Once at the retailer location, the container 30 is opened to allow removal of the strip products 20. However, as shown in FIG. 3, the container 30 itself is then converted into a display that can be mounted or secured at a desired location at the retailer so that the strip products 20 can hang down in a vertical manner.

To allow for such conversion, the container 30 is formed with at least one flap 32 that can be unfolded outwardly away from the container interior to form a vertical hanger. The flap 32 has at least one opening or slot 34 formed therethrough. The opening 34 has a height and width allowing for insertion of at least one strip product 20 through the opening so that the strip product can hang from the flap in a vertical manner. The opening 34 may preferably have a width matching the width of the strip product 20 to facilitate retention of the strip product on the flap 32.

In a preferred embodiment, the container 30 includes four side walls 36 with a flap 34 pivotably connected to each side wall. The container 30 further includes a bottom 38 from which the side walls 36 extend to form an interior. The four flaps 32 have a size and shape to form the top of a fully enclosed container 30 when folded inwardly toward the interior of the container 30. The flaps 32 are pivotable about their respective side wall between a closed position, as shown in FIG. 2, in which they enclose the container 30, and an open position, as shown in FIG. 3, in which they form a hanger for supporting the strip products 20 in a vertical manner.

Figure 4:
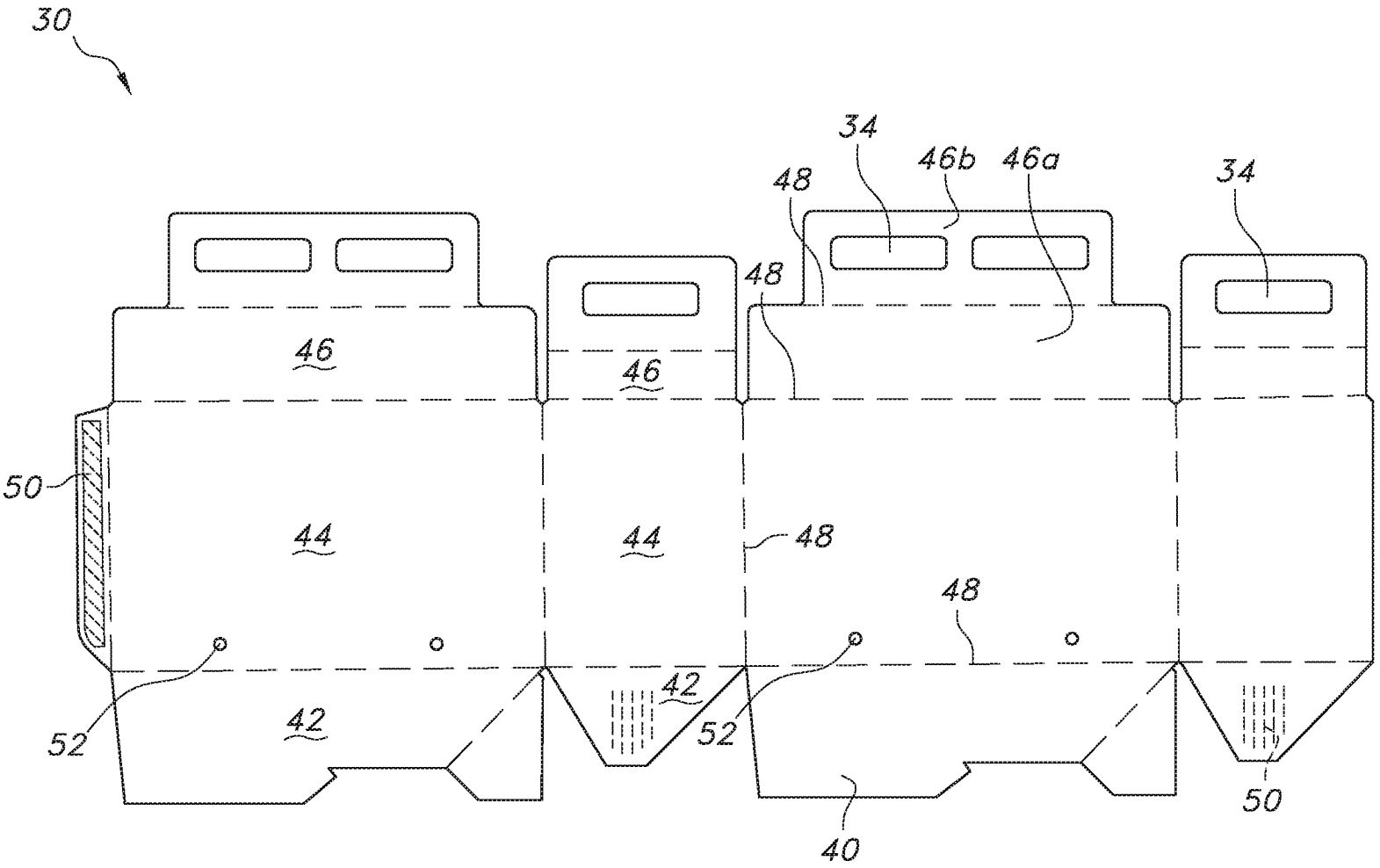
FIG. 4 is a plan view of one embodiment of a blank of stock material that could be used for forming the display of the present invention.

As shown in FIG. 4, the container 30 can be formed from a single blank 40 of stock material, such as cardboard or other durable material. The blank 40 can include bottom panels 42 connected to side panels 44, which, in turn, are connected to flap panels 46. Fold lines 48 or creases are provided between the panels to facilitate folding of the blank 40 to form the container 30. Thus, the side panels 44 are folded about each other to form the side walls 36 of the container and the bottom panels 42 are folded about the side panels to form the bottom 38 of the container. One or more panels can also be provided with an adhesive 50 to secure the panels together.

As shown in FIG. 4, the flap panels 46 are connected to the side panels 44 with a fold line 48 therebetween. At least one opening 34 is formed through each flap panel 46 through which the strip products 20 can be suspended.

FIG. 4 further shows a preferred embodiment in which each flap panel 46 has a lid portion **46*a* and a hanger portion 46*b* separated by a fold line 48. The lid portion 46*a* is pivotably connected to a side panel 44 about a fold line 48 and the hanger portion 46*b* is pivotably connected to the lid portion opposite the side panel. The lid portions 46*a* have a size and shape so as to fully enclose the container interior upon assembly. The hanger portion 46*b* are folded inwardly into the container interior upon assembly and are formed with the openings 34** for suspending the strip product.

Thus, upon assembling the container, the lid portions **46*b* together form the top of the container, while the hanger portions are disposed within the interior of the container 30. In this manner, the strip pack products 20 can be "pre-suspended" within the openings 34 of the hanger portions 46*b* when loading the container 30 so that, when opening the flaps 32, the strip pack products 20** will simply fall out of the container and be suspended from the flaps in condition for display.

Also in a preferred embodiment, at least one side panel 44 has one or more mounting openings 52, which allow the container 30 to be secured to a vertical surface when displayed. Mounting openings can also be provided in one or more bottom panels 42, which would allow the container 30 to be mounted to a horizontal surface. In this manner, the blank 40 can be assembled to form the container 30 and the container can then be hung by nylon strings from a shelf or hanging hooks in the retails market to form the display 10 shown in FIG. 3 for displaying the strip products 20.

As a result of the present invention, a display 10 is provided in which the outer carton and the hangers are integrated into a single unit such that the hanger is the outer carton. The outer carton combination can be formed from a single blank, wherein, as the bottom flaps of the carton are opened, the strip packages extend downward. The carton can be mounted or secured so that the strip products hang down in a vertical manner.

It should be apparent to those skilled in the art that the described embodiments of the present invention provided herein are illustrative only and not limiting, having been presented by way of example only. As described herein, all features disclosed in this description may be replaced by alternative features serving the same or similar purpose, unless expressly stated otherwise. Therefore, numerous other embodiments of the modifications thereof are contemplated as falling within the scope of the present invention as defined herein and equivalents thereto. While various embodiments of the present invention are specifically illustrated and/or described herein, it will be appreciated that modifications and variations of the present invention may be effected by those skilled in the art without departing from the spirit and intended scope of the invention.

What is claimed is:

1. A container for transporting and displaying strip pack products, the container comprising:

a container housing defining a housing interior for containing strip pack products, said container housing including a plurality of side walls and a plurality of flaps pivotable between a closed position at least partially enclosing said housing interior and an open position, each of the plurality of flaps integrally connected to corresponding side wall such that, in the open position, each of the plurality of flaps extends from the corresponding side wall in a generally vertical direction, each of the plurality of flaps having at least one opening defined thereon; and a strip pack product suspended from the at least one opening of each of said plurality of flaps in a generally vertical manner in said open position.

2. The container as defined in claim 1, wherein said container housing is formed with a mounting opening for mounting the container to a support.

3. The container as defined in claim 1, wherein said container housing is formed by folding a single blank of stock material.

* * * * *